United States Patent [19]

Kosch, Sr. et al.

[11] Patent Number: 4,961,295

[45] Date of Patent: Oct. 9, 1990

[54] METAL SLAT AND WALL SYSTEM UTILIZING SAME

[76] Inventors: Paul Kosch, Sr., 14925 Boom Rd.; Paul J. Kosch, 15885 Vinecrest, both of Spring Lake, Mich. 49456

[21] Appl. No.: 167,644

[22] Filed: Mar. 14, 1988

[51] Int. Cl.[5] ..... A47B 5/00

[52] U.S. Cl. ..... 52/36; 52/551; 52/387; 211/94.5

[58] Field of Search ..... 52/531, 551, 387, 386, 52/588, 377, 36 R; 211/94, 94.5

[56] References Cited

U.S. PATENT DOCUMENTS

| | | | |
|---|---|---|---|
| 1,772,694 | 8/1930 | White | 52/588 |
| 2,457,086 | 12/1948 | Mitchell | 52/377 |
| 2,612,246 | 9/1952 | Whitehouse | 52/588 |
| 2,907,417 | 10/1956 | Doerr | 52/377 |
| 3,152,669 | 10/1964 | Johnston | 52/588 |
| 3,945,164 | 3/1976 | Winsor | 52/377 |
| 3,969,866 | 7/1976 | Kyne | 52/588 |
| 4,196,554 | 4/1980 | Anderson | 52/588 |
| 4,257,204 | 3/1981 | Rieger | 52/539 |
| 4,607,753 | 4/1986 | Radek | 52/588 |

FOREIGN PATENT DOCUMENTS

| | | | |
|---|---|---|---|
| 2820235 | 11/1979 | Fed. Rep. of Germany | 52/551 |
| 3438759 | 7/1985 | Fed. Rep. of Germany | 211/94.5 |
| 6712141 | 4/1968 | Netherlands | 52/551 |

*Primary Examiner*—Henry E. Raduazo

*Attorney, Agent, or Firm*—Price, Heneveld, Cooper, DeWitt & Litton

[57] ABSTRACT

A slatted wall or panel assembly which may be easily assembled and possesses substantial structural rigidity as well as an attractive appearance, includes a plurality of structurally-supportive backing members having a plurality of mutually-spaced protruding ears which are generally rigid and which form load-bearing slat supports, and further includes a plurality of slats which are mounted upon the backing member by hanging the slats upon the load-bearing ears in interlocked relation with the ears and with adjacent slats by means of flanged edge extremities extending along each slat. Each pair of adjacent slats collectively defines an L-shaped recess which is adapted to receive therein a substantially L-shaped arm of a display shelf, hook, etc., for mounting display item upon the assembly. The slats are configured to permit manufacture by roll-forming bending operations such that the slats may be of sheet metal construction and economically manufactured in quantity.

15 Claims, 3 Drawing Sheets

METAL SLAT AND WALL SYSTEM UTILIZING SAME

BACKGROUND OF THE INVENTION

The present invention pertains to componentized wall and support systems, and more particularly to a novel slat and support system for the fabrication of wall structures, display panels and the like.

It is common in offices and retail establishments to secure shelves and their supports, as well as various other articles, accessories and devices to walls and panel systems in order to position various items within easy reach and/or sight of the user or customer, and there are also a variety of componentized wall and panel systems by which both temporary and permanent wall-like structures may be readily set up and put in place to divide larger areas into desired work spaces, etc. Some such wall systems incorporate various means for supporting shelves and the like on or in conjunction with the wall portions, to provide greater usefulness and flexibility Prior artisans have fashioned wall and panel systems in which a plurality of slats have been arranged in rows such that the slats collectively define recesses adapted to mount various support members (e.g., shelves, racks, hangers and the like). Typically, such support members are provided with L-shaped flanges which cooperate with the recesses in order to securely hold the support members in place on the wall or panel Hence, the mounting of shelves, etc. is performed in an easy and efficient manner, without the use of screws or the like.

Nevertheless, the systems developed heretofore have consisted of a complicated and comparatively expensive construction, as well as a complicated process of fabrication, and/or they have lacked the structural strength desired. Most past systems of the slat wall type have used wood slats, and these are frequently weak and require expensive wood-working fabrication Whether of wood or metal, most prior slat wall systems also require comparatively slow and expensive assembly, such as by welding or bolting each individual slat to a backing member, as is shown in U.S. Pat. Nos. 4,450,970 (Shepherd), 3,172,540 (Berge), and 4,579,308 (Jensen). Moreover, many of the prior systems include no overlapping of the slats and are thereby severely limited in their holding capabilities; that is, the amount of weight they can support.

SUMMARY OF THE INVENTION

The aforementioned problems are overcome in the present invention, wherein slatted walls and panels may be easily and attractively formed by use of novel slats shaped to be readily, yet securely, interlocked and coupled together. Furthermore, the novel slats in accordance with the invention are preferably of sheet metal form, and lend themselves to manufacture by roll-forming techniques.

More specifically, the slatted wall assembly of the present invention includes at least one, and preferably a series, of mutually-spaced backing members which are secured to an existing support, such as a stud, and which include a plurality of protruding ears. The novel slats are mounted onto such backing members such that the slats are interlocked with the ears of the backing members and with each other to thereby increase the strength and structural integrity of the wall assembly. The mounted slats define a recess between each pair of adjacent slats, each such recess being adapted to receive the mounting flanges of shelves, hooks, etc. for mounting such devices on the wall or panel.

The user may, by employing this system, easily construct an attractive and durable wall or panel. Once the backing members are mounted into position, the slats are assembled in an easy and efficient interlocking system which requires no separate fastening means such as screws, welding, etc. Further, by interlocking all of the pieces of the assembly together, the strength of the wall assembly to support heavy items thereon is greatly increased. Yet, despite the great versatility gained by providing the recesses and the structural strength achieved by the interlocking arrangement, the novel wall assembly provides desirable manufacturing economies and advantages, and possesses a very attractive appearance in which the recesses and interlocking extremities are hidden from view.

These and other objects, advantages and features of the present invention will be more fully understood and appreciated by reference to the written specification and appended drawings.

DETAILED DESCRIPTION OF THE PREFERRED EMBODIMENT

Figures 1, 2, 3, 4, 5, 6:
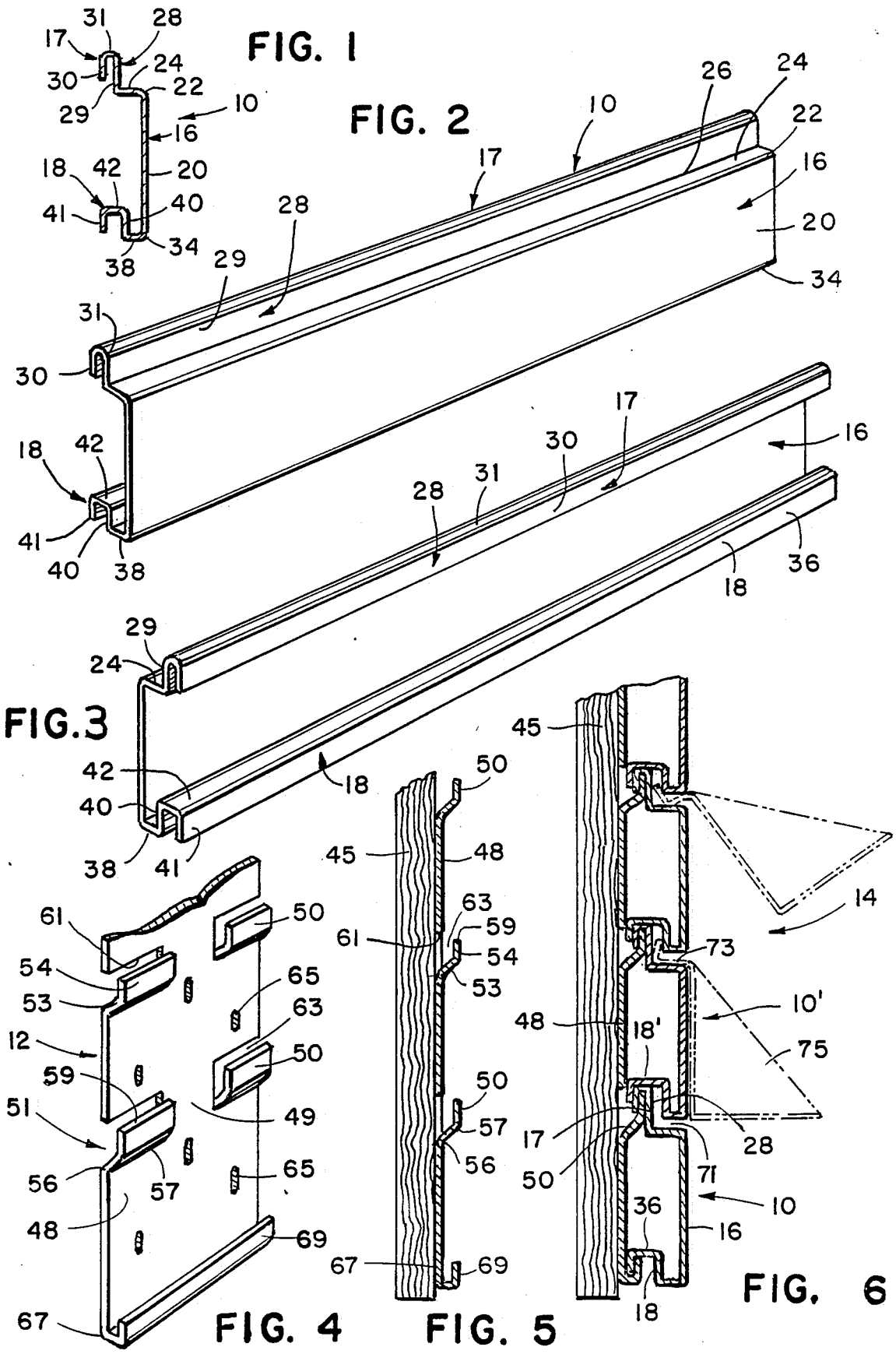
FIG. 1 is a side view of a slat of the present invention.
FIG. 2 is a perspective view of the forward side of a slat of the present invention.
FIG. 3 is a perspective view of the rearward side of a slat of the present invention.
FIG. 4 is a partial perspective view of a backing member of the present invention.
FIG. 5 is a side cross-sectional view of a backing member secured to a stud.
FIG. 6 is a side view of the wall assembly of the present invention.

In the preferred embodiment, slatted wall and panel structures are easily assembled through the use of uniquely shaped slats 10 (FIGS. 1-3). Slats 10 are interlocked with each other and with a backing member 12 (FIGS. 4-6) to easily form a durable and attractive wall assembly 14. Slats 10 are composed preferably of sheet metal, but could be composed of other materials possessing the requisite characteristics.

Slats 10 are generally of an elongated channel-like configuration which include a body 16, an upper flange structure 17 and a lower flange structure 18. Body 16 is typically an elongated planar member having a forward surface 20 which primarily defines the appearance of wall assembly 14. Hence, while a smooth planar forward surface 20 is illustrated (FIGS. 2, 9 and 20), various designs or shapes could be provided thereon for decorative purposes Projecting rearwardly and upwardly from an upper longitudinal edge 22 of body 16 is an upper flange structure 17 of inverted U-shaped configuration which is fixedly connected to body 16, extends the entire length thereof (FIGS. 2 and 3), and having a hanger means for mounting the slat. Upper flange structure 17 includes a first flange 24 which extends rearwardly from upper edge 22 at substantially a right angle thereto. Extending along the distal edge 26 of first flange 24 is an upwardly projecting wall section 28. Wall section 28 includes first and second legs 29, 30 connected by a relatively sharp arcuate bight portion or radius wall 31. First and second legs 29, 30 are typically at a slight angle to each other, for reasons to be described below, but could be positioned in a parallel relationship. Although second leg 30 in the most preferred embodiment is shorter than first leg 29, this is not essential to the construction of wall assembly 14.

In a similar manner, extending lengthwise along the lower edge 34 of body 16 and fixedly secured thereto is a lower flange structure 18 (FIGS. 2 and 3). Lower flange structure 18 is also of inverted U-shaped configuration and is joined to body 16 through a connecting flange 38. The lower flange structure 18 opens downwardly and includes a pair of legs 40, 41 joined by a mid-portion or bight 42. Hence, as can be best seen in FIG. 1, lower flange structure 18 in cooperation with body 16 defines a horizontally-disposed generally S-shaped configuration Unlike most metal slat walls, whose slats are formed by extrusion, the slats 10 of the invention are preferably of sheet metal, and bent into the above-described configuration. It is to be pointed out that the novel structural configuration of the present slats (that is, the size, shape and positioning of the various flanges, and the fact that they are preferably interconnected by curvingly bent bridging portions rather than comprising sharply-angled portions directly adjacent one another) permits such bending by roll-forming techniques. Thus, very advantageous manufacturing capacities are provided in accordance with the invention, since roll-forming of sheet metal (such as steel) is well known to be far less expensive than extrusion (which usually entails more expensive alloys such as aluminum, etc.). Furthermore, the resulting integrally-flanged sheet metal slats are not only relatively lightweight (compared to extruded metal or wood slats, for example), but they are also very strong for their weight. Additionally, the roll-forming of sheet-form steel is not only less expensive than extrusion, but in addition lends itself more readily to desirable finishing technique, since not only may the finished steel slats be readily painted, but the slats may actually be roll-formed from pre-finished stock without impairing the finished surface. Of course, other fabrication procedures and materials may also be utilized to provide slats in accordance with the basic concept involved since the design affords desirable assembly, operational, and structural advantages regardless of how the slats are manufactured.

Figure 11:
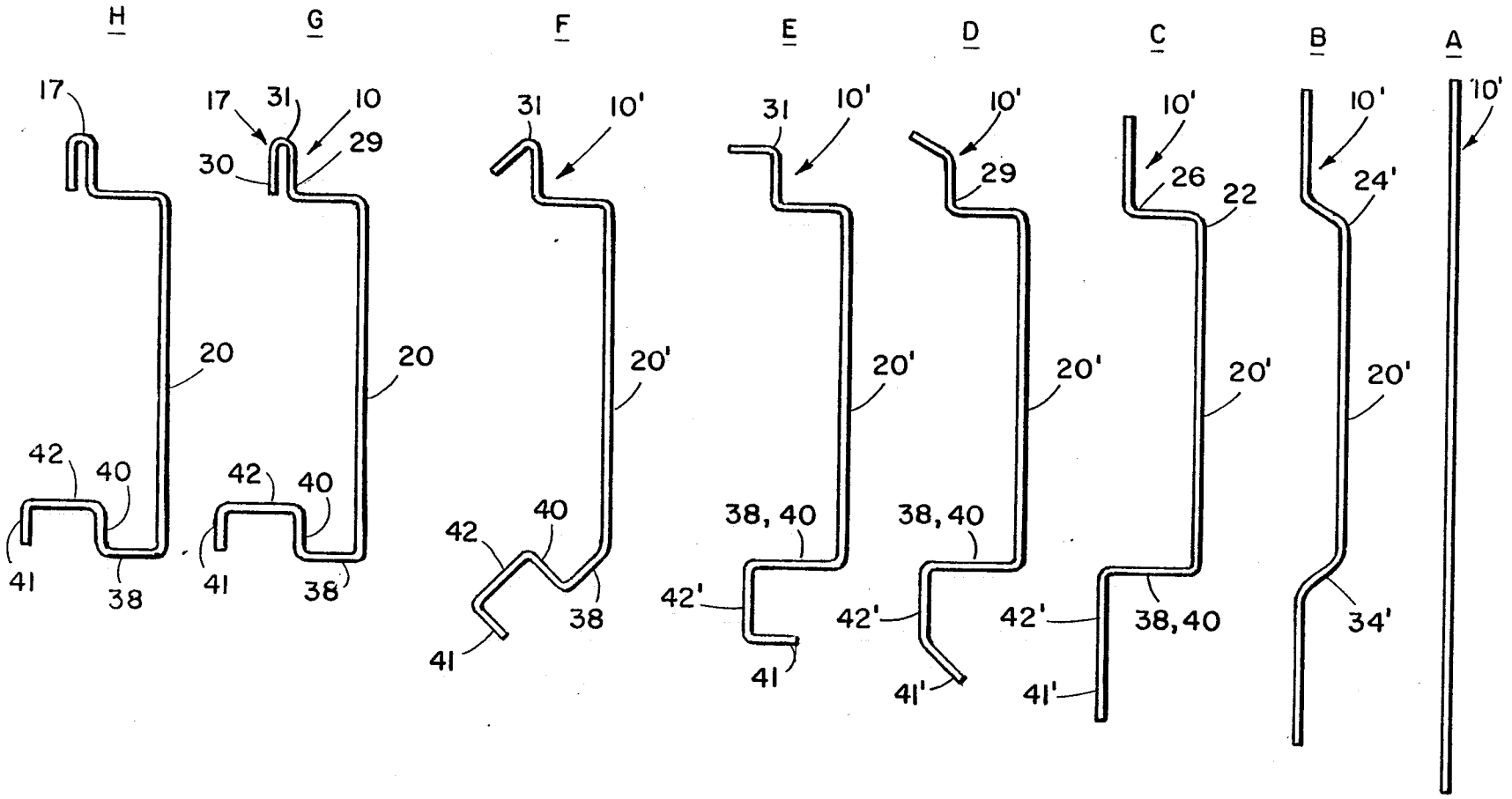
FIG. 11 is a composite view showing the successive changes in cross-section which occur during manufacture of a slat from a planar sheet metal blank by roll-forming

FIG. 11 shows (proceeding from right to left) the gradual development in cross-sectional shape as a planar sheet metal blank proceeds sequentially through a series of roll-forming stages, designated generally by the capital letters A-H inclusive, to illustrate the basic nature of the preferred roll-forming process. As seen in this multiple-view figure, the planar sheet metal blank, designated 10', undergoes approximately seven (for example) successive forming changes which progressively form the different contours and flanges which are particularly discussed in connection with the other figures. This may comprise a generally continuous process in which the sheet material is fed from a supply roll; of course, shorter lengths of stock may also be used. As illustrated in the various bends are made somewhat gradually, as part of an integrated sequence, and this fact is illustrated in FIG. 11 by use of numbers corresponding to those used in the other figures, but which are primed where the particular shape or portion involved is in an intermediate stage of formation. As will be understood, each roll-forming stage involves use of a matching pair of specially-configured die rolls, between which the sheet of stock is pressed, and which bend the cross section of the stock at each stage in accordance with the outer shape of the roller pair located at that stage. Thus, each roller pair may be considered to have a composite shape which is basically the complement of the different shapes shown in FIG. 11. Of course, this figure is of a representative character, and is somewhat generalized. In actual production, there may be either a greater or lesser number of roll-forming stages, and there may be some specific variations in the particular progressive shape changes shown in this figure.

Figure 8:
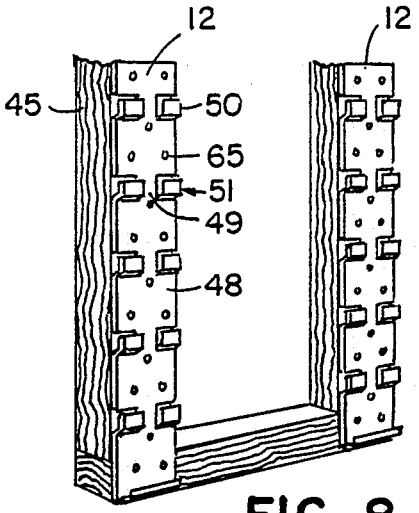
FIG. 8 is a perspective view of the backing members of the present invention mounted to studs.

As noted above, the wall or panel assembly 14 also includes backing members 12 (FIG. 4). Backing members 12 are generally mounted to studs or other supporting members 45 (FIGS. 5 and 6) by the use of screws or the like (FIG. 8). Backing members 12 are preferably of metal construction and must have reasonable rigidity and strength since they support and carry the completed wall and everything secured thereto; however, it will be appreciated that the supporting members (e.g. stud walls or the like) to which the backing members are secured will strengthen and reinforce the backing members, thereby allowing them to be of less rigid construction where the supporting members are in fact comparatively strong. In a particular and reasonably representative embodiment, the backing member 12 may be made of cold-rolled steel sheet or plate on the order of about 0.070" thick. (Of course, the slats 10 may be made of considerably thinner sheet stock in most instances where the loads they are to carry are comparatively low.)

Backing member 12 comprises a flat main portion 48 which is provided with a plurality of laterally-projecting ears 50 (FIGS. 4 and 5). Ears 50 are preferably paired into sets 51, such that the ears 50 of each set 51 are aligned transversely across plate member 48. Between the ears 50 of each set 51 is defined a central portion 49. A plurality of sets of ears 51 are provided in a spaced-apart relationship along the complete length of the flat main member 48.

Each ear 50 is preferably formed as an integral portion of plate member 48 which has been cut and bent outwardly as an angled member, including first and second portions 53, 54. First portion 53 is fixedly attached along one side 56 to plate member 48 and projects outwardly therefrom at an angle of approximately 60°. Fixedly attached to an opposite side 57 of first portion 53 is second portion 54. Second portion 54 is positioned substantially parallel to plate member 48 and includes a free distal end 59. Due to the fact that the ears 50 are formed integrally from plate member 48, they are likewise strong and rigid in nature, particularly in view of their size and shape. Where ears 50 are so formed, plate member 48 defines an adjacent edge 61 which together with distal end 59 defines a recess or gap 63.

The backing member 12 is also provided with a plurality of holes 65 along the length. Holes 65 are arranged in columns to facilitate the passage of screws 46 or the like, for mounting backing members 12 to studs or other supporting members 45. Typically, three columns of mounting holes 65 are provided to ensure the secure mounting of baking members 12, and thus ensure the structural integrity of the wall system 14 itself. Of course, not every mounting hole 65 need be used in a given situation. Also, the mounting holes 65 are preferably elongated somewhat to allow for limited positional adjustment of one backing member relative another, to ensure mutual alignment.

At the bottom end 67 of backing member 12 is an upwardly-opening U-shaped base 69 (FIGS. 4 and 5). Base 69 is designed to provide a nearly flush surface with the floor or other such horizontal surface (i.e. desk, table, etc.) for a more appealing appearance. As seen in FIG. 6, base 69 is formed as a shallow bend so as to receive the inner lower leg flange 41 of slat 10, thereby anchoring the bottom of the lowermost slat in a wall. Thus, base 69 is actually unseen in the completed wall 14 due to the downward extension of body 16 of slat 10.

Figure 9:
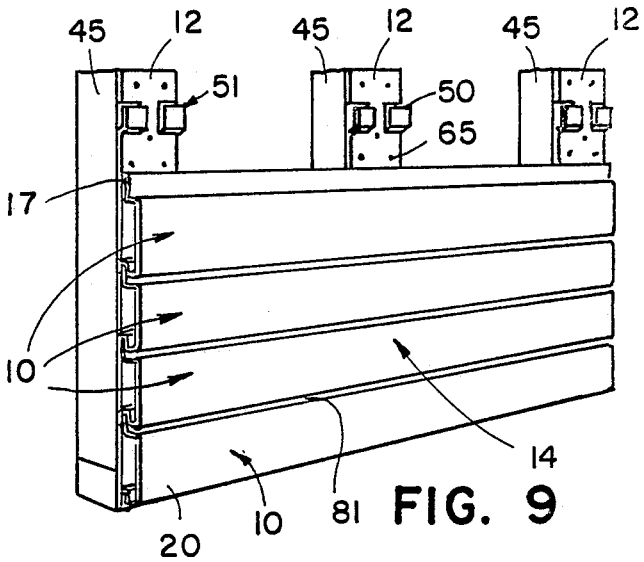
FIG. 9 is a perspective view of the wall assembly of the present invention in a partially assembled state.
Figure 7:
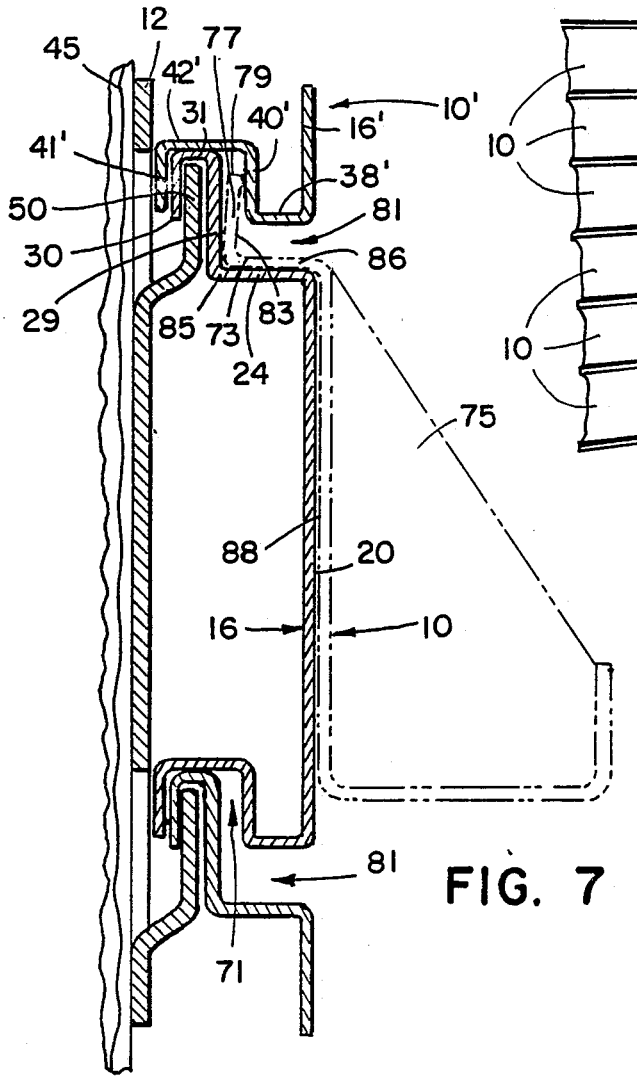
FIG. 7 is an enlarged side cross-sectional view of the wall assembly of the present invention.
Figure 10:
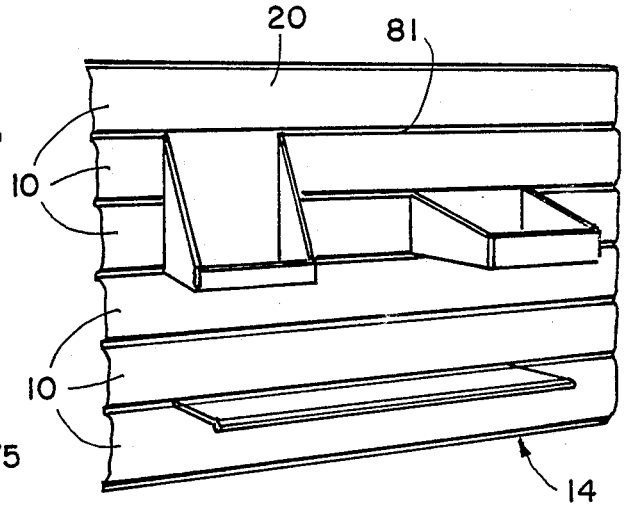
FIG. 10 is a perspective view of the wall assembly of the present invention.

In the building of wall or panel assembly 14, backing members 12 are first secured to studs or other supporting members 45 through the use of screws or the like received through holes 65 (FIG. 8). A first slat 10 is positioned adjacent backing member 12 such that leg 41 of lower flange structure 18 is received into C-shaped base 69 of backing member 12, with leg 30 of hook member 28 (along the top of slat 10) hooked over and received behind the first set of ears 51 within the recesses or gaps 63 formed thereby (FIGS. 5, 7 and 9). In this way, slat 10 is held securely in position and supported by the projecting ears 50, without the use of any additional fastening means such as screws, welding, etc.

Next, a second slat 10' is mounted to backing member 12 directly above the first slat 10. Slat 10' is positioned such that outer leg 41' is received into gap 63 of the first set of ears 51. More specifically, leg 41' is snugly received between leg 30 of slat 10 and central portion 49 of plate member 48. As noted above, leg 30 is constructed at a slight angle so that it is inclined toward plate member 48 at its distal edge 26. This arrangement ensures a snug fit of the respective legs of slats 10, 10' behind the first set of ears 51. Note also, that in a manner similar to slat 10, leg 30' of slat 10' is received behind the second set of ears 51'. As can be seen clearly in FIG. 9, this construction is continued until the entire wall or panel has been built.

Referring to FIGS. 6 and 7, it may be seen that each adjacent pair of slats 10, 10' cooperate to collectively define an L-shaped recess 71. Recess 71 is designed to receive therein a substantially L-shaped mounting arm 73 (shown in phantom) for a shelf 75 or the like. Of course, numerous other types of structures such as display hooks and holders or the like could be mounted into recess 71, so long as a similar L-shaped arm 73 was utilized.

Recess 71 is preferably dimensioned so as to be substantially larger than L-shaped arm 73 which it receives. This is to enable the easy mounting and removal of shelf 75 from the wall or panel assembly 1. That is, in the mounting of shelf 75 to wall or panel assembly 4, shelf 75 is first tilted upwardly (FIG. 6) so that the generally upright portion 77 of arm 73 is positioned horizontally or at a shallow angle thereto. Distal end 79 of upright portion 77 is then passed through horizontal gap 81 and into vertically-extending recess 71. Once distal end 79 has cleared the connecting flange 38 and inner leg 40 of lower flange structure 18', the shelf may be rotated downwardly until the forward face 83 of upright portion 77 engages inner leg 40'. Note also that bottom surface 85 of horizontal portion 86 of shelf 75 thus comes to rest flush against the flange 24 of slat 10. In this case, though not required to so mount an item to a wall or panel assembly 14, a rearward face 88 of shelf 75 lies flush against forward surface 20 of slat body 16 for extra support. Shelf 75 may of course be removed by performing the steps in the opposite order just described above.

Of course, it is understood that the above descriptions are merely those of preferred embodiments of the invention Various other embodiments, as well as many changes and alterations, may be made without departing from the spirit and broader aspects of the invention as defined in the claims. Further, it should be understood that while the term "wall" is used throughout the above descriptions, and the slats are referred to as being horizontally disposed to form an upright "wall", these particular spatial orientations are not at all the only ones in which the invention may be used and are merely used for convenience.

The embodiments of the invention in which an exclusive property or privilege is claimed are defined as follows:

1. A slatted display wall assembly providing integral mounting means for display-support members, comprising in combination:

at least one generally rigid backing member having means defining a plurality of generally rigid projecting ears forming load-bearing slat supports;

a plurality of slats having central portions with an outer surface forming the front face of said wall assembly and flanged edge portions defining hanger means for mounting said slats, said slats being mountable adjacent one another and supported in place on said backing member through engagement of said flanged edge portion hanger means over the tops of said projecting ears from a position located at the front of said wall;

said edge portions being configured to define a recess between at least selected pair of said slats mounted adjacent one another on said projecting ears, said recess having a size and shape for receiving and mounting display support members in a manner such that they extend outward and beyond said front face of said slats;

said slats having sufficient structural strength to bear loading applied to said display support members at a point outboard of said front face without crushing of said central slat portion or edge portions, whereby loading placed upon said display support members is transferred to and carried by said projecting ear slat supports through said hanger means and flanged edge portions.

2. The wall assembly of claim 1 wherein:

said backing member includes at least two of said ears mutually spaced along the length of said backing member; and wherein said slats include an upper flanged edge portion and a lower flanged edge portion, said slats being mountable on said backing member such that said upper flanged edge portion is received over at least one of said ears and said lower flanged portion is received over another of said spaced-apart ears.

3. The slatted wall assembly of claim 2 in which said lower flanged edge portion of one slat is received over the same ear as is the upper flanged edge portion of an adjacent slat, whereby said slats and ears are interlocked for greater structural integrity of said wall assembly.

4. The slatted wall assembly of claim 3 in which said lower flanged edge portions of said one slat and said upper flanged edge portions of said adjacent slat are configured such that they collectively define said recess between slats.

5. The slatted wall assembly of claim 4 in which said defined recess is of a substantially L-shaped configuration.

6. The slatted wall assembly of claim 1 in which said defined recess is of a substantially L-shaped configuration.

7. The slatted wall assembly of claim 1 in which each of said slats includes a body having a forward and rearward side, an upper flanged edge portion, and a lower flanged edge portion;

said upper flanged edge portion including a first flange which projects rearwardly from said body at substantially a right angle thereto, and a hooking member disposed at least partially above said first flange; and said lower flanged edge portion projecting rearwardly from said body and having a hooked portion joined to said body by a connecting flange.

8. The slatted wall assembly of claim 7 in which said body includes a flat, elongated planar member and in which said upper and lower flanged edge portions extend lengthwise of and along opposite edges of said body.

9. The slatted wall assembly of claim 7 in which said upper flanged edge portion hooking member and said lower flanged edge portion hooking member both define recesses which open downwardly to receive said ears of said backing member.

10. A slat for use in a slatted wall assembly, comprising:

a body having a forward and rearward side, an upper flange structure, and a lower flange structure;

said upper flange structure including a first flange portion which projects rearwardly from said body and has a downwardly and rearwardly-opening hook member which extends from said first flange portion, said hook member comprising a hanger which provides a primary load-carrying support means for said slat by engagement over a generally rigid vertically-supportive load-bearing substructure to suspend the slat therefrom and transfer loading thereto carried by the slat;

said lower flange structure including a first flange portion which projects rearwardly from said body and at least a second flange portion extending downwardly from said first flange portion;

said first flange portion of said lower flange structure being located at a predetermined distance below the first flange portion of said upper flange structure so as to define a recess between the adjacent upper and lower first flange portions of adjacent slats positioned with their respective upper and lower flange structures in mutual engagement;

said second flange portion of said lower flange structure being located so as to lie in juxtaposition with and behind at least portions of the upper flange structure of the adjacent slat located immediately below and engaged over the supportive substructure, to thereby index said lower flange structure in place relative to said substructure.

11. The slat of claim 10 in which said body includes a generally flat, elongated member and in which said upper and lower flange structures extend along the side edges of said body.

12. The slat of claim 10 in which said hook member and said second flange portion both define recesses which open downwardly and are adapted to receive projecting support member.

13. The slat of claim 10 in which said body and said upper and lower flange structures comprise an integral, unitary, one-piece member.

14. The slat of claim 13 wherein said one-piece member comprises a roll-formed structure.

15. A slat for use in a slatted display wall assembly having integral slat-suspending and display-supporting structure, said slat comprising:

a body having a forward and rearward side, an upper flange structure, and a lower flange structure, said body comprising an integral one-piece member formed from thin sheet stock;

said upper flange structure including a first portion which projects rearwardly from said body, and which has an integral downwardly-opening hook member extending therefrom;

said lower flange structure including a first portion which projects rearwardly from said body and at least a second portion extending angularly from said first portion;

said upper flange structure and said lower flange structure both defining mutually cooperative integral portions of a mounting means for said slat and both of said upper flange structure and lower flange structure also comprising mutually cooperative means for supporting a display carried by said slat and transferring the associated loading to a fixed load-bearing means; said hook member and first portion of said upper flange structure together with said first and second portion of said lower flange structure providing a two-point suspension means for structurally supporting said slat and associated display upon a pair of mutually-spaced, rigidly-fixed load-bearing substructures by resting engagement of said hook member and angularly-extending second portion thereover.

* * * * *